US006636000B2

(12) United States Patent
Asami et al.

(10) Patent No.: US 6,636,000 B2
(45) Date of Patent: Oct. 21, 2003

(54) PLASMA DISPLAY DEVICE WITH FLEXIBLE CIRCUIT BOARDS AND CONNECTORS

(75) Inventors: Fumitaka Asami, Kawasaki (JP); Tadao Miyasaka, Kawasaki (JP); Kazuyuki Harada, Kawasaki (JP); Masatoshi Hira, Kawasaki (JP); Norio Matsumoto, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 52 days.

(21) Appl. No.: 09/929,069

(22) Filed: Aug. 15, 2001

(65) Prior Publication Data

US 2002/0041155 A1 Apr. 11, 2002

(30) Foreign Application Priority Data

Oct. 6, 2000 (JP) ..... 2000-308393

(51) Int. Cl.[7] ..... G09G 3/10

(52) U.S. Cl. ..... 315/169.3; 315/169.1; 439/237; 439/233; 439/260; 349/149; 349/150

(58) Field of Search ..... 313/582, 583; 315/169.1, 169.3, 169.2; 349/149, 150, 151, 152; 439/233, 237, 260, 267

(56) References Cited

U.S. PATENT DOCUMENTS 4,121,135 A * 10/1978 Hunt et al. ..... 439/66
4,289,364 A * 9/1981 Strom et al. ..... 439/67
4,416,497 A * 11/1983 Brandsness et al. ..... 439/492
4,738,625 A * 4/1988 Burton et al. ..... 439/59
5,631,756 A * 5/1997 Itazawa ..... 349/58
6,081,306 A * 6/2000 Nagano ..... 349/32
6,124,677 A * 9/2000 Lardeau et al. ..... 315/169.4
6,160,349 A * 12/2000 Nagai ..... 315/85
6,160,605 A * 12/2000 Murayama et al. ..... 349/152
6,359,390 B1 * 3/2002 Nagai ..... 315/169.1
6,407,508 B1 * 6/2002 Kawada et al. ..... 315/169.3

FOREIGN PATENT DOCUMENTS

| | | |
|---|---|---|
| JP | 63-6674 | 1/1988 |
| JP | 6-44038 | 11/1994 |
| JP | 11-627458 | 11/1999 |
| JP | 11-627503 | 11/1999 |

OTHER PUBLICATIONS

Patent Abstracts of Japan of JP 05217509 dated Aug. 17, 1993.
Patent Abstracts of Japan of JP 2000206897 dated Jul. 28, 2000.
Patent Abstracts of Japan of JP 11327458 dated Nov. 26, 1999.
Patent Abstracts of Japan of JP 03160488 dated Jul. 10, 1991.
Patent Abstracts of Japan of JP 2000150033 dated May 30, 2000.

* cited by examiner

*Primary Examiner*—Haissa Philogene
(74) *Attorney, Agent, or Firm*—Staas & Halsey LLP

(57) ABSTRACT

A plasma display device has a pair of substrates having electrodes and terminals provided at ends of the electrodes. Driving circuits supply a driving voltage to the electrodes via flexible printed circuit boards to emit light. Connectors are detachably attached to the substrate. The connector includes a housing and terminal members disposed in the housing, with the terminal member having a U-shaped cross-sectional shape, so that a first portion as one leg of the "U" contacts the terminal of the electrode and a second portion as another leg of the "U" contacts the conductor of the flexible connecting member. The terminals of the electrodes are arranged in a staggered manner at the end of the substrate.

26 Claims, 14 Drawing Sheets

PLASMA DISPLAY DEVICE WITH FLEXIBLE CIRCUIT BOARDS AND CONNECTORS

BACKGROUND OF THE INVENTION

1. Field of the Invention

The present invention relates to a plasma display device.

2. Description of the Related Art

An AC plasma display device (PDP) comprises a plasma display panel having two glass substrates disposed opposite to each other and a circuit part for controlling and driving. One of the two glass substrate has a plurality of address electrodes disposed in parallel with each other, and the other glass substrate has a plurality of sustain electrodes disposed in parallel with each other and perpendicular to the address electrodes. The sustain electrodes include X-electrodes and Y-electrodes which are disposed in an alternate fashion. Display cells are formed between the adjacent X-electrode and Y-electrode. The circuit part includes several driving circuits for supplying driving voltages to the electrodes of the substrate. Flexible printed circuit boards are used to connect the terminals of the electrodes of the glass substrate with the driving circuits.

The electrodes of the glass substrates are formed linearly in such a manner as to extend substantially across the substrates, and terminals of the electrodes are formed at the ends of the glass substrates. The driving circuits are disposed on a chassis mounted on the outer surface of one of the glass substrates, whereby the driving circuits are disposed within an area occupied by the glass substrate having a large area, this helping prevent the further increase in the overall size of the plasma display device.

Therefore, the plane in which the electrodes and terminals of the glass substrate are disposed is different from the plane in which the driving circuits are disposed. Thus, one ends of the flexible printed circuit boards are connected to the terminals of the electrodes of the glass substrate and the other end to the driving circuits directly or via an intermediate circuit board connected to the driving circuit, with the intermediate portions of the flexible printed circuit boards being bent. Thus, the use of the flexible circuit boards is reasonable and effective.

AC plasma display device of this type is disclosed in, for example, Japanese Unexamined Patent Publication (Kokai) No. 11-327503 and No. 11-327458.

Conventionally, terminals formed at one end of the flexible printed circuit board are fixed and connected directly to terminals of electrodes on the glass substrate through thermal-compression bonding using an anisotropic conductive film. The anisotropic conductive film comprises a thermoplastic resin and metallic particles dispersed in the resin and has a function as an adhesive for mechanically bonding the flexible printed circuit board to the glass substrate and a function as a conductive member for electrically connecting terminals of the electrodes of the glass substrate with terminals of one end of the flexible printed board.

In addition, Japanese Unexamined Utility Model Publication (Kokai) No. 63-6674 discloses a construction in which terminals formed at one end of the flexible printed circuit board are connected to terminals of electrodes of the glass substrate, and thereafter, the flexible printed circuit board is pressed and held onto the glass substrate using a clip, and a deviation preventing metal fixture is additionally used. Japanese Unexamined Patent Publication (Kokai) No. 10-83873 discloses a connector for a portable apparatus in which the glass substrate is connected to the circuit board without using flexible printed circuit boards.

Terminals are provided on the glass substrate at a very small pitch and it is especially small on the address side. A certain length of time is required to accurately align the terminals on the flexible printed circuit boards with those provided on the glass substrate in a thermal bonding process. In addition, in this process, the thermoplastic resin needs to be heated to a sufficient temperature for deformation, and time is also needed until the heated thermoplastic resin is set with the heated condition being maintained after thermal bonding, thus a relatively long period of time is needed when compared with other processes.

In addition, a pair of glass substrates are integrated into a plasma display panel, and the flexible printed circuit boards are then fixed to the glass substrates integrated into the plasma display panel. In the event that something abnormal occurs in either the flexible printed boards or the plasma display panel after the flexible printed circuit boards are fixed to the glass substrates, the flexible printed circuit boards cannot be removed from the display panel, this causing a situation in which neither the flexible printed circuit boards nor the plasma display panel can be used any more. Due to this, in the event that the flexible printed circuit boards produce defects that cannot be recovered, whereas the plasma display panel is still in good condition, the expensive plasma display panel cannot be used.

Therefore, a connector has been demanded which can removably fix both members to each other without directly fixing the flexible printed circuit board to the glass substrate. Furthermore, a reduction in working time during the connecting process is required. In addition, it is also required to independently replace a member suffering from a failure in the event there occurs a failure for some reason in a member in the circuit portion including the flexible printed circuit boards and the plasma display panel. Thus, it is desired that the environment should be protected from being adversely affected by reducing the number of members wasted, as well as reducing the price of products. In addition, this problem also applies to similar flexible connecting members such as flat cables and flat flexible cables.

SUMMARY OF THE INVENTION

The object of the present invention is solve the aforesaid problem, and to provide a plasma display device in which flexible members can be detachably attached to a substrate by connectors.

According to the present invention, there is provided a plasma display device comprising a pair of substrates, each substrate having a plurality of electrodes and a plurality of terminals provided at ends of respective ones of the plurality of electrodes, a driving circuit for supplying a driving voltage to the electrodes on one of the substrates, a flexible connecting member comprising plural conductors extending from the driving circuit, and a connector detachably attached to the substrate, each connector having a housing and a plurality of terminals disposed in the housing, the terminal having a first portion contacting a terminal of the electrode and a second portion contacting a corresponding conductor of the flexible connecting member.

In the above construction, the terminals of the flexible connecting members such as the flexible printed circuit boards are not connected directly to the electrodes of the substrate but are electrically connected to the substrate via connectors electrically connected with the end of the substrate. Consequently, the flexible connecting members can be separated from the substrate by removing the connectors from the substrate. In addition, work for connecting the flexible connecting members to the substrate with the connectors can be carried out more simply and in shorter time than work for connecting the flexible connecting members to the substrate through thermal-compression bonding using an anisotropic conductive film.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
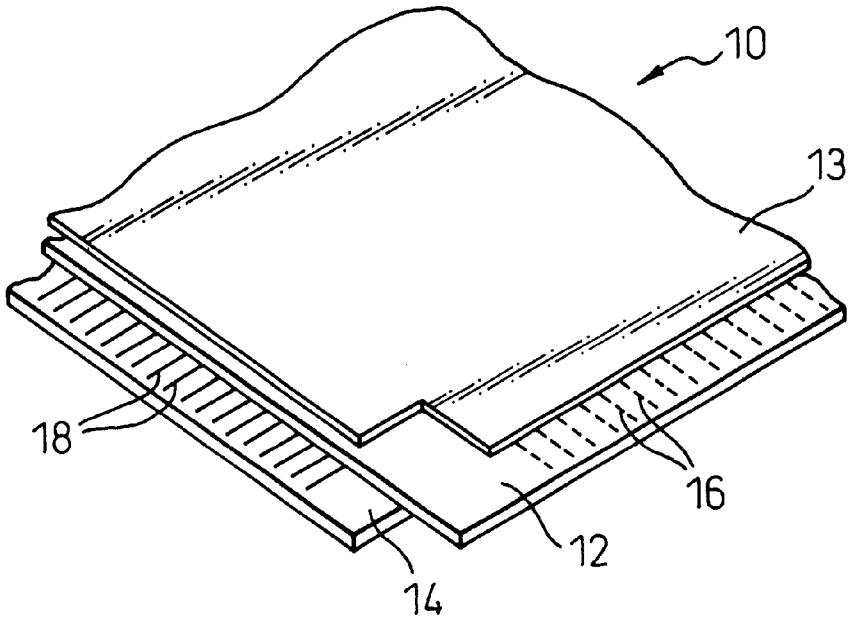
FIG. 1 is a perspective view showing a plasma display device according to an embodiment of the present invention.
Figure 2:
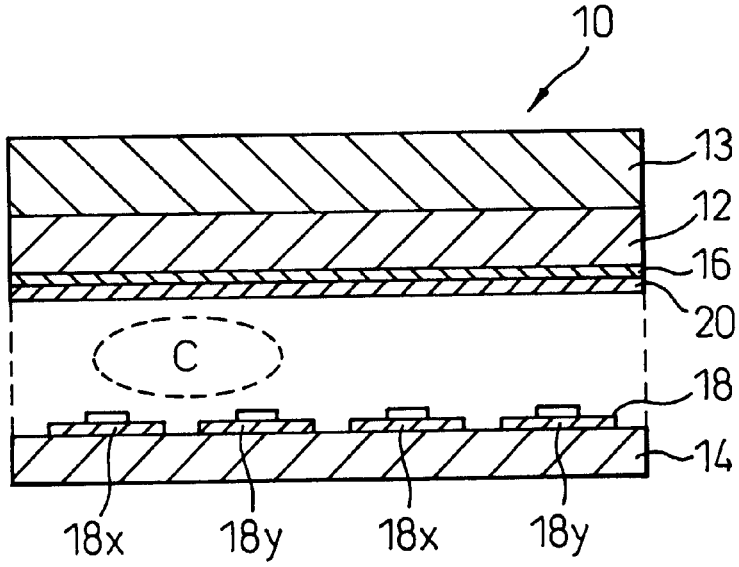
FIG. 2 is a cross-sectional view of the plasma display device of FIG. 1.
Figure 3:
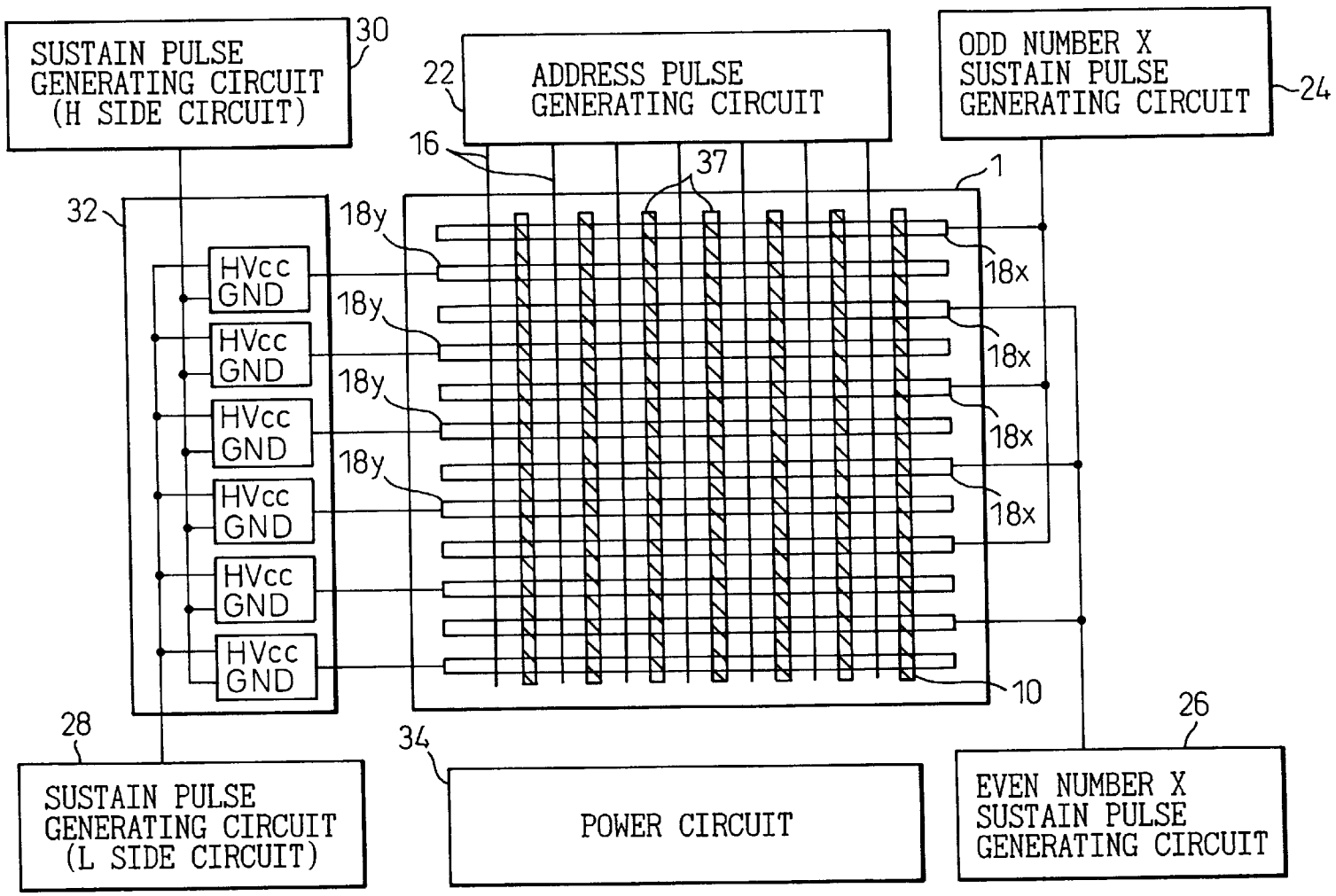
FIG. 3 is a view showing electrodes and driving circuits of the plasma display device shown of FIGS. 1 and 2.

FIG. 1 is a perspective view showing a plasma display device according to an embodiment of the present invention. FIG. 2 is a cross-sectional view of the plasma display device of FIG. 1. FIG. 3 is a view showing electrodes and driving circuits of the plasma display device shown in FIGS. 1 and 2.

In FIGS. 1 and 2, the plasma display device 10 comprises a plasma display panel having a pair of glass substrates 12 and 14 opposed to each other, a chassis 13 provided on one of the glass substrates 12, and driving circuits provided on the chassis 13 for driving and controlling (refer to FIG. 3). The glass substrate 12 has electrodes 16 and the glass substrate 14 has electrodes 18. The electrodes 16 and 18 are disposed perpendicular to each other.

FIG. 3 is a view showing the electrodes 16 and 18 and the driving circuits provided on the plasma display panel 1 (the glass substrates 12 and 14). The glass substrate 12 has a plurality of address electrodes 16 disposed in parallel with one another, and the glass substrate 14 has a plurality of sustain electrodes 18 disposed in parallel with one another and perpendicular to the address electrodes 16. The address electrodes 16 are formed at a pitch of, for example, 0.25 mm, whereas the sustain electrodes 18 are formed at a pitch of, for example, 0.5 mm. A bulkhead 37 is formed between the adjacent two address electrodes 16 in parallel with the address electrodes 16.

The sustain electrodes 18 include X-electrodes 18*x* and Y-electrodes 18*y* which are disposed in an alternate fashion. Namely, the sustain electrodes 18 include a first X-electrode 18*x*, a first Y-electrode 18*y*, a second X-electrode 18*x*, a second Y-electrode 18*y*, a third X-electrode 18*x*, a third Y-electrode 18*y*, a fourth X-electrode 18*x*, a fourth Y-electrode 18*y* and so forth, in that order, as viewed from the top in FIG. 3.

The driving circuits include an address pulse generating circuit 22, X-electrode sustain pulse generating circuits 24 and 26, Y-electrode sustain pulse generating circuits 28 and 30, and a scanning circuit 32, which are connected to an electric power source circuit 34 and a control circuit (not shown). The address pulse generating circuit 22 supplies driving pulses to the address electrodes 16. The odd number X electrode sustain pulse generating circuit 24 supplies driving pulses to the odd number X-electrodes 18*x*, while the even number X electrode sustain pulse generating circuit 26 supplies driving pulses to the even number X-electrodes 18*x*. The Y-electrode sustain pulse generating circuits 28 and 30 supply driving pulses to the Y electrodes 18*y* via the scanning circuit 32. The driving circuits and other electric circuits are disposed on the chassis 13 shown in FIG. 1.

Figure 10:
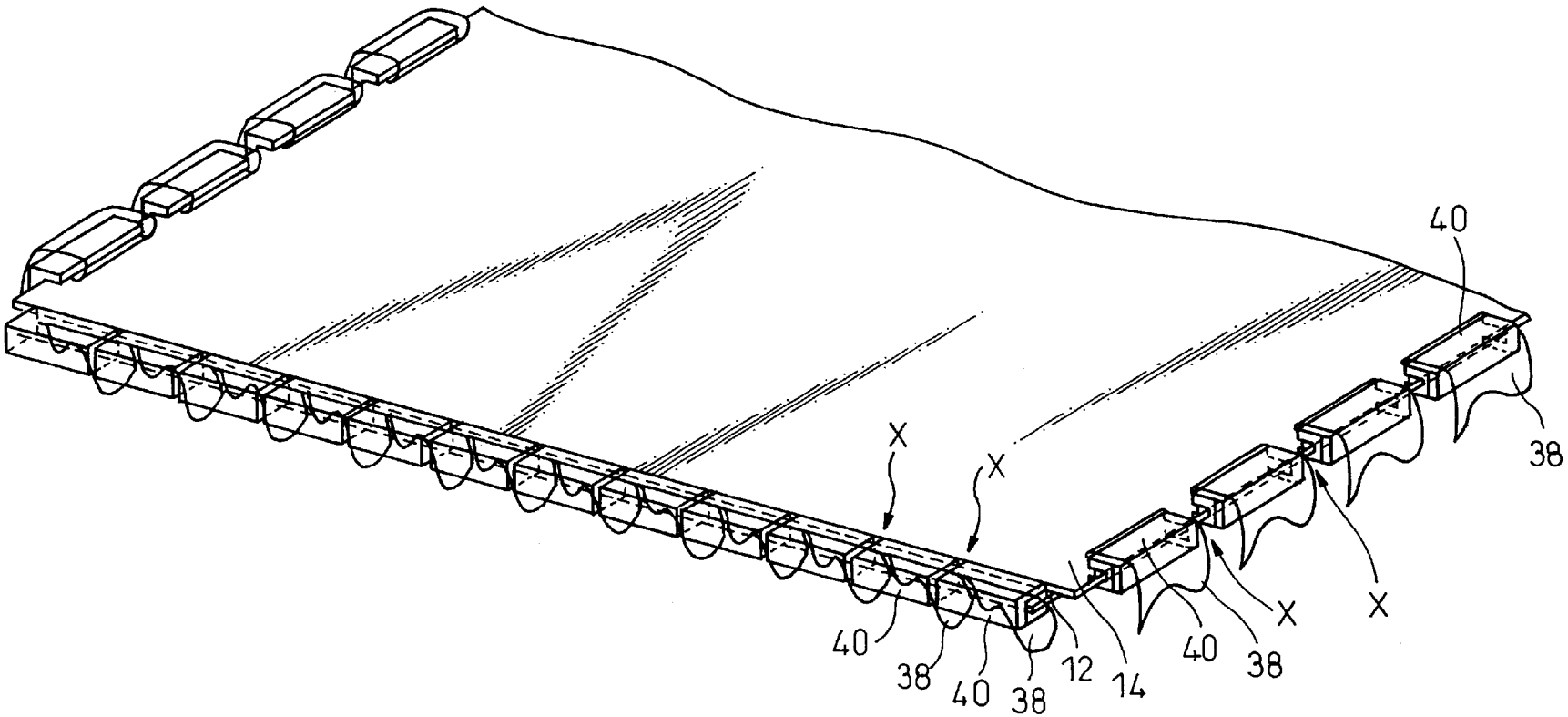
FIG. 10 is a perspective view showing the glass substrate having the connectors attached thereto.

As is clear from FIG. 1, the planes where the electrodes 16 and 18 of the glass substrates 12 and 14 are disposed are different from the plane where the driving circuits 22 to 32 on the chassis 13 are disposed. Thus, as shown in FIG. 10, flexible printed circuit boards 38 and connectors 40 are used to connect the electrodes 16 and 18 with the driving circuits 22 to 32. Note that one end of the flexible printed circuit boards 38 can be connected any of the driving circuits 22 to 32 directly or via intermediate circuit boards.

In this plasma display device 10, the side of the glass substrate 14 is the display side. Display cells are formed between the adjacent X-electrodes 18*x* and Y-electrodes 18*y*. In one display cell, a high writing voltage pulse is applied between the address electrode 16 and the Y-electrode 18*y* to produce a priming, and a sustain voltage is applied between the X-electrode 18*x* and the Y-electrode 18*y* to continue the discharge, whereby the light is emitted. Reference character C in FIG. 2 shows that discharge is being produced.

Figure 4:
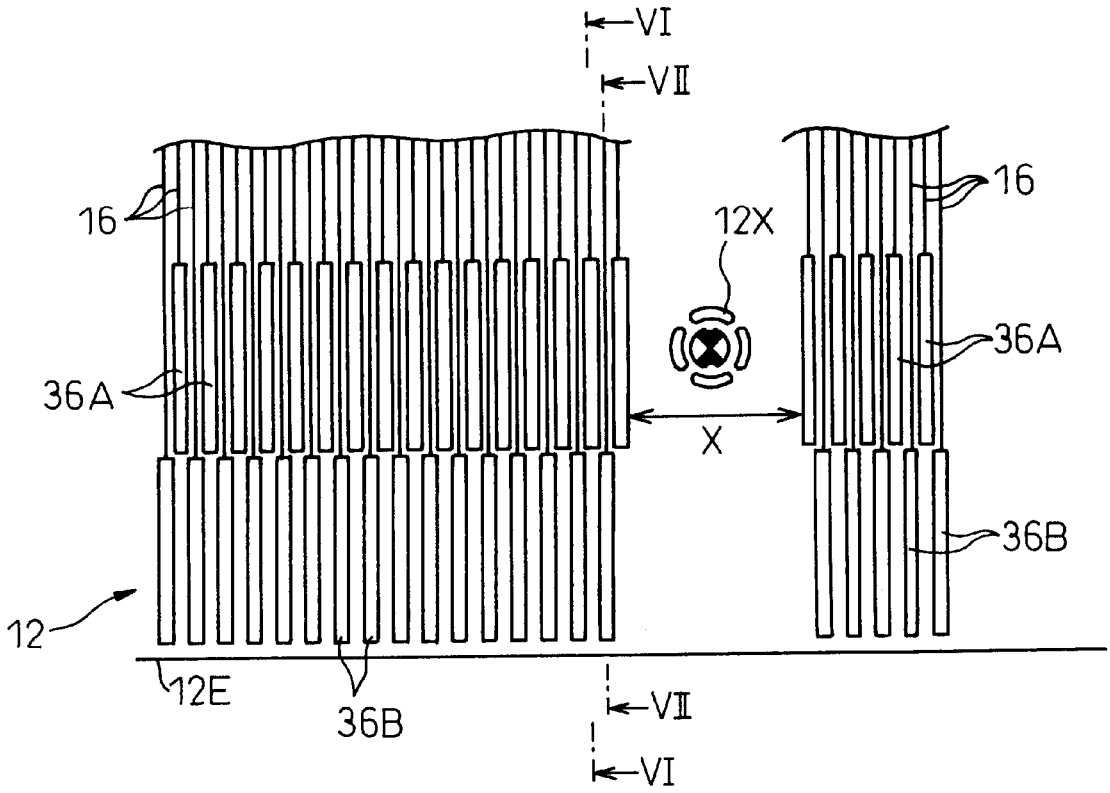
FIG. 4 is a view showing part of the glass substrate and the electrodes shown in FIGS. 1 to 3.

FIG. 4 is a view showing part of the address electrodes 16 formed on the glass substrate 12 of FIGS. 1 to 3. Terminals 36A and 36B are provided at the ends of the address electrodes 16 on the glass substrate 12. The terminals 36A and 36B are disposed at different distances from the end or outer edge 12E of the glass substrate 12. The terminals 36B are disposed closer to the edge 12E of the glass substrate 12, and the terminals 36A are disposed farther away from the edge 12E of the glass substrate 12 than the terminals 36B. In this embodiment, the terminals 36A and 36B are disposed alternately in a staggered fashion. Thus, even if the address electrodes 16 are disposed at a narrow pitch, the terminals 36A and 36B can be made larger, compared with the case where the terminals 36A and 36 are arranged in a line, and therefore, the connecting work of the terminals 36A and 36B becomes easier. In addition, the sustain electrodes 18 on the glass substrate 14 can also be provided with terminals that are disposed in the staggered fashion as done with the address electrodes 16.

Figure 5:
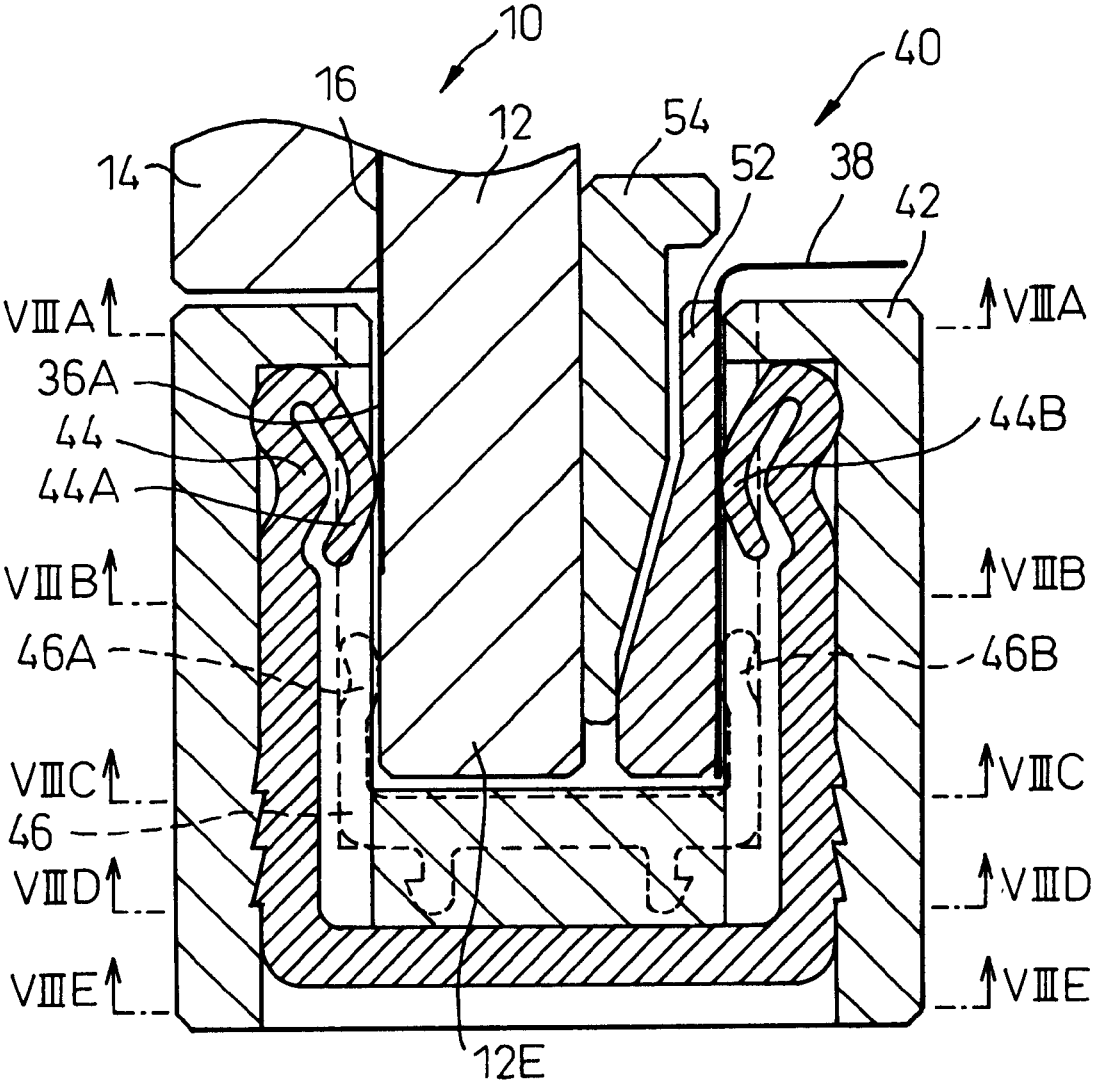
FIG. 5 is a cross-sectional view showing the connector used in the plasma display device of FIGS. 1 to 3.
Figure 6:
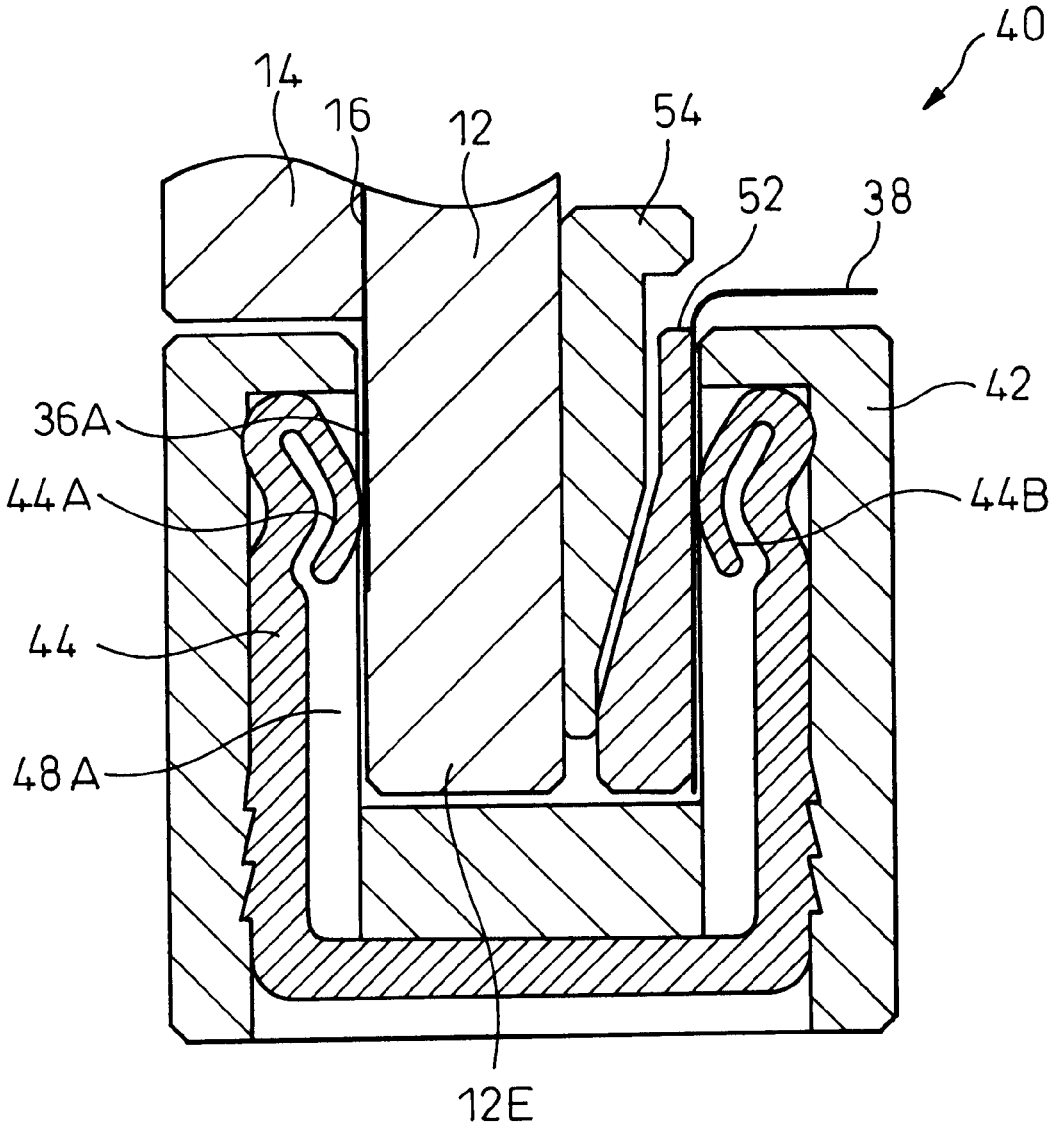
FIG. 6 is a cross-sectional view taken along the line VI—VI in FIG. 4.
Figure 7:
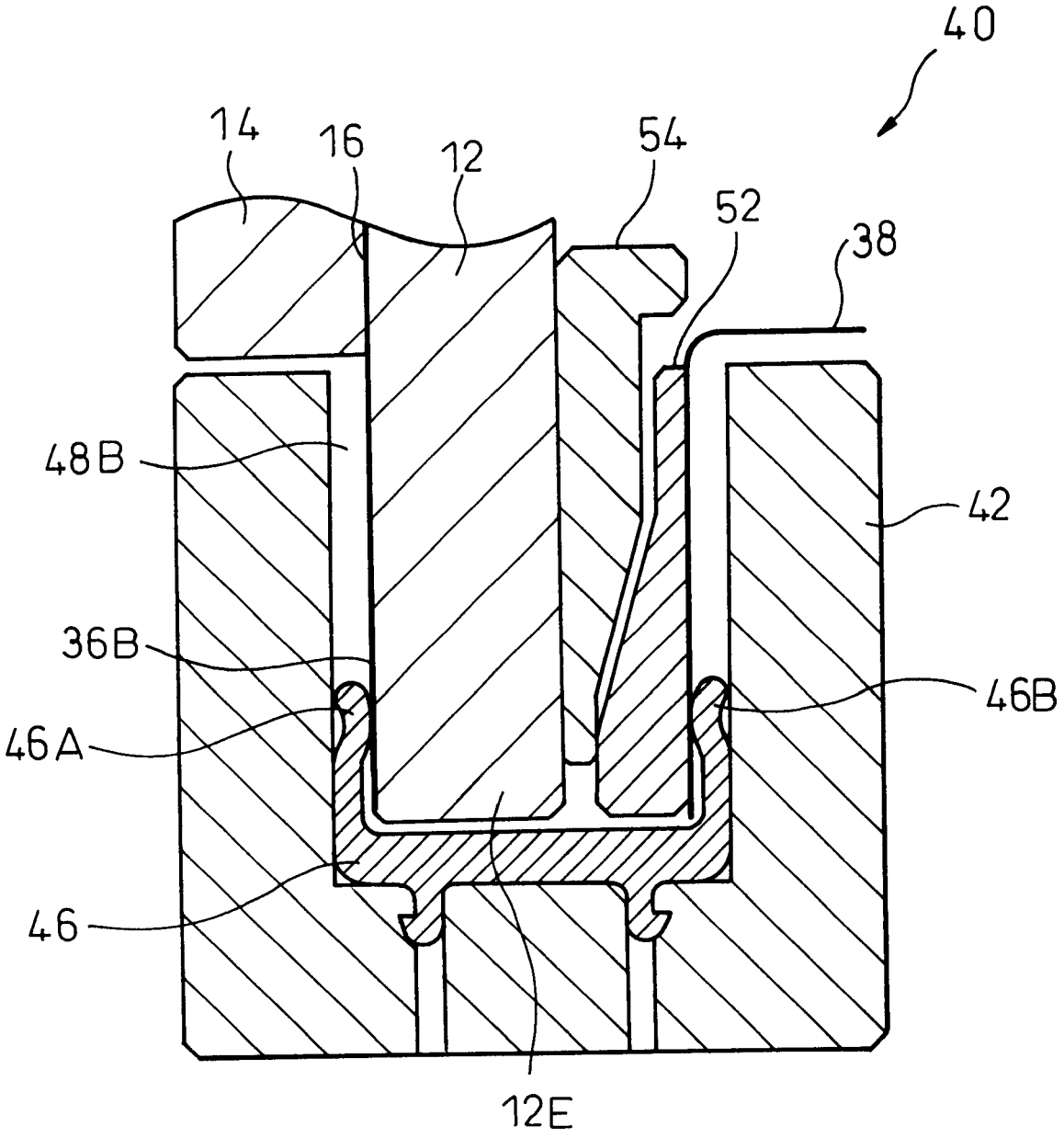
FIG. 7 is a cross-sectional view taken along the line VII—VII in FIG. 4.
Figure 8A:
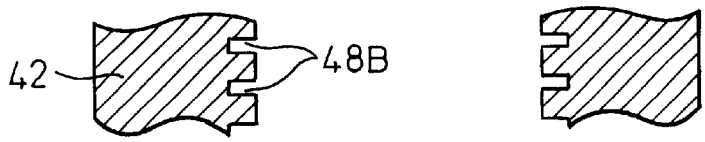
FIGS. 8A to 8E are cross-sectional views taken along the lines VIIIA—VIIIA, VIIIB—VIIIB, VIIIC—VIIIC, VIIID—VIIID, VIIIE—VIIIE in FIG. 5, respectively.
Figure 8B:
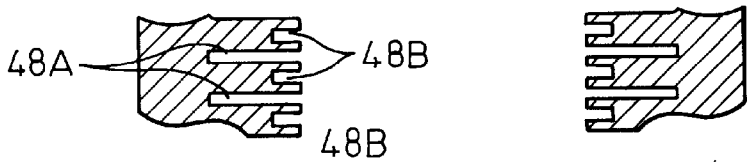
Figure 8C:
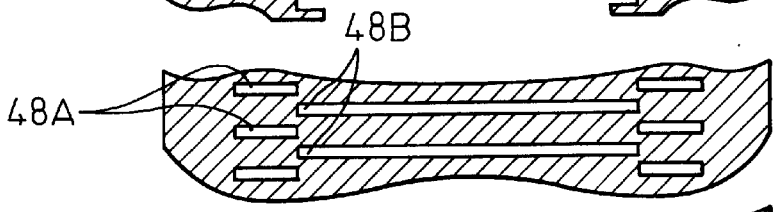
Figure 8D:
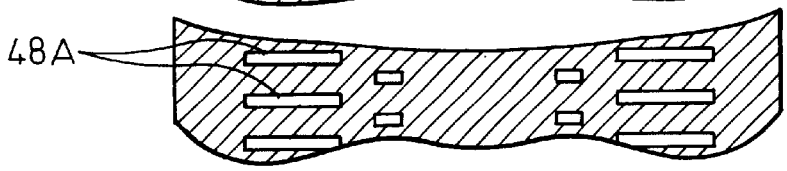
Figure 8E:
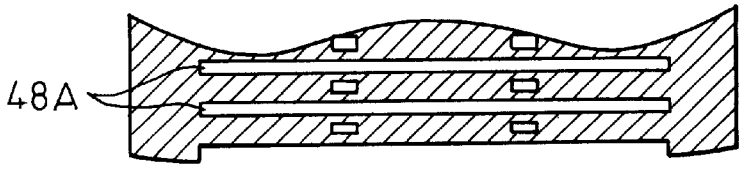

FIGS. 5 to 8 are views showing the connector 40 used in the plasma display device 10. FIG. 5 is a cross-sectional view of the connector 40, FIG. 6 is a cross-sectional view, similar to that in FIG. 5, but taken along the cross-sectional plane corresponding to the line VI—VI in FIG. 4 (the cross-sectional plane passing through the terminals 36A), FIG. 7 is a cross-sectional view taken along the cross-sectional plane corresponding to the line VII—VII in FIG. 4 (the cross-sectional plane passing through the terminals 36B), and FIGS. 8A to 8E are cross-sectional views taken along lines VIIIA—VIIIA, VIIIB—VIIIB, VIIIC—VIIIC, VIIID—VIIID, VIIIE—VIIIE in FIG. 5 (where terminals are not shown). In FIGS. 5 to 7, the end of the glass substrate 12 protrudes from the end of the glass substrate 14, and the terminals 36A and 36B of the electrodes 16 shown in FIG. 4 are formed at the protruding end portion of the glass substrate 12.

The connector 40 has a housing 42 detachably attached to the end portion of the glass substrate 12 and terminals 44 and 46 disposed in the housing 42 and formed in a U-shaped cross section. The terminals 44 and 46 of the connector 40 are provided at the same pitch as those of the terminals 36A and 36B of the electrodes 16. The housing 42 is molded from liquid crystal resin having a small thermal expansion coefficient, has a U-shaped cross-sectional shape and is constructed so as to be detachably attached to the end portion of the glass substrate 12. The width or distance between opposite inner surfaces of the housing 42 is larger than the thickness of the glass substrate 12, so that the glass substrate 12 and first and second wedge members 52 and 54 can be inserted into the space between the opposite inner surfaces of the housing 42.

Figure 9:
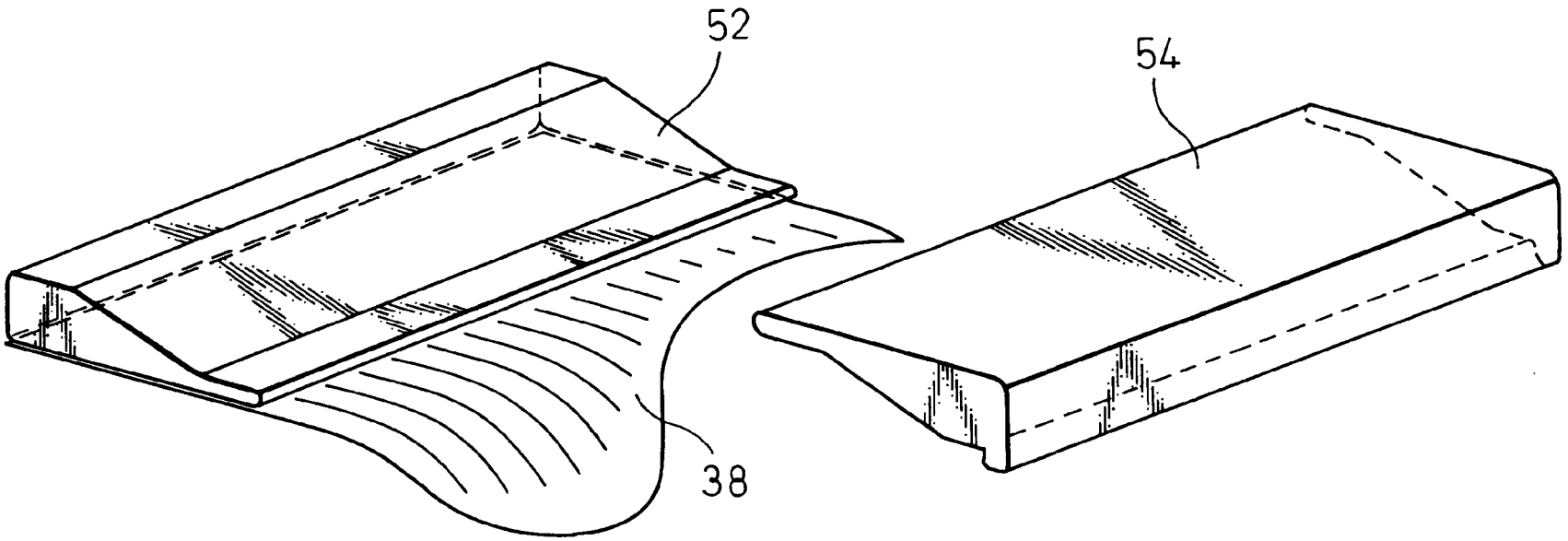
FIG. 9 is a perspective view showing first and second wedge members and the flexible printed circuit board.

FIG. 9 shows the first and second wedge members 52 and 54 and the flexible printed circuit board 38. The flexible printed circuit board 38 is disposed between the terminals 44 and 46 and the first and second wedge members 52 and 54. Preferably, the first wedge member 52 is bonded to the end portion of the flexible printed circuit board 38.

Parallel grooves 48A and 48B are formed in the housing 42, and the terminals 44 and 46 having the U-shaped cross sectional shape are disposed in the grooves 48A and 48B, respectively. Namely, the terminal 44 is embedded in the groove 48A, as shown in FIG. 6, and the terminal 46 is embedded in the groove 48B, as shown in FIG. 7. FIGS. 8A to 8E show the grooves 48A and 48B formed in the housing 42. The two types of grooves 48A and 48B are made to open toward the space where the glass substrate 12 is received and are arranged in an alternate fashion. The grooves 48A and 48B and terminals 44 and 46 of the connector 40 are disposed at the same pitch as those of the terminals 36A and 36B of the electrodes 16. The terminals 44 of the connector 40 are inserted into the grooves 48A from below as viewed in FIG. 5, while the terminals 46 of the connector 40 are inserted into the grooves 48B from above as viewed in FIG. 5. The terminals 44 and 46 of the connector 40 are formed of, for example, a sheet metal having thikness of 0.08 to 0.1 mm which is formed by precision blanking.

The length of the legs of the U-shaped terminal 44 of the connector 40 is longer than the length of the legs of the U-shaped terminal 46 thereof. The upper end portion 44A of one of the legs of the U-shaped terminal 44 is folded back inwardly so that the folded portion elastically contacts the terminal 36A of the electrode 16. The upper end portion 44B of the other leg of the U-shaped terminal 44 is folded back inwardly so that the folded portion elastically contacts the corresponding terminal of the flexible printed circuit board 38. In addition, the upper end portion 46A of one of the legs of the U-shaped terminal 46 is bent inwardly so that the bent portion elastically contacts the terminal 36B of the electrode 16. The upper end portion 46B of the other leg of the U-shaped terminal 46 is bent inwardly so that the bent portion elastically contacts the corresponding terminal of the flexible printed circuit board 38.

The terminals 44 and 46 of the connector 40 are formed laterally symmetrical with respect to the central axis thereof, so that one of them contacts the terminal 36A or 36B of the electrode 16 and the other contacts the terminal of the flexible printed circuit board 38. Therefore, the terminals 44 and 46 can be fitted in the housing 42 without any error. In addition, since the terminal 44 is inserted into the housing 42 from below, while the terminal 46 is inserted from above, there is no risk of the terminals 44 and 46 being erroneously inserted into the housing.

Regarding the terminal 44 of the connector 40, the upper end portions 44A and 44B are folded back inwardly so that the connector can move smoothly when it is moved in the direction in which the connector is inserted into the glass substrate 12, while the frictional force generated at the contacting portion is increased and the terminal 44 bites into the glass substrate 12 when it is moved in the direction in which the connector is removed from the glass substrate 12. According to this construction, a stable contact can be continuously ensured even if a force is exerted in the direction in which the connector 40 is dislocated from the panel.

The first wedge member of resin (pressure member) 52 having a cross sectional shape with an inclination angle is bonded and fixed to the back side of the flexible printed circuit board 38 with respect to the side having terminals, and the second wedge member 54 of metal or resin is forced into the gap between the glass substrate 12 and the first wedge member 52, whereby a pressure of the same magnitude can be applied to both the glass substrate 12 side and the flexible printed circuit board 38 side by making use of the elasticity of the terminals 44 and 46 of the connector 40 to thereby ensure a certain contact pressure. The angles of the cross sections of the first and second wedge members 52 and 54 are selected such that a frictional fixing force caused by the pressure exerted by a certain number of terminals of the connector can well bear a force exerted in the direction in which the connector is dislocated by environmental conditions such as an external force, vibrations and any impact to which the panel is subjected, in consideration of frictional coefficients between the surface of the glass substrate 12 and the surface of the second wedge member 54 and between the surfaces of the first and second wedge members 52 and 54.

The connector 40 shown in FIGS. 5 to 8 is described in relation to the address electrodes 16. A connector constructed similarly to this connector 42 can be used for the sustain electrodes 18. However, in the case of a color display device, the number of address electrodes 16 is three times larger the number of sustain electrodes 18 and the pitch between the adjacent address electrodes 16 becomes smaller than that between the adjacent sustain electrodes 18. Therefore, the pitch of terminals 44 and 46 of the connector for use with the sustain electrodes 18 becomes larger than that of the terminals 44 and 46 of the connector 40 for use with the address electrodes 16. Consequently, two kinds of connectors are needed. However, when only one kind of the terminals 44 or 46 are set in the housing 42 and the other terminals 46 or 44 are not set in the housing, the connector 40 shown in FIGS. 5 to 8 can also be used for the sustain electrodes 18. In this case, terminals provided at the ends of the sustain electrodes 18 do not have to be disposed in the staggered fashion as is done with the terminals 36A and 36B of the address electrodes 16 shown in FIG. 4.

The display part of the plasma display panel is constructed as an aggregation of intersecting points of the address electrodes 16 and the sustain electrodes 18, and they are arranged continuously at equal intervals both vertically and horizontally. If all the address electrodes 16 and the sustain electrodes 18 are extended straight to the ends of the glass substrates, terminals can be arranged uniformly all over the glass substrates, without any discontinuity. This is a convenient way of producing plasma display panels, but it may not be an optimum way to realize electric connections of terminals.

In FIG. 4, a certain number of terminals 36A and 36B are dealt with as a group, and an interval X is provided between two groups of terminals, the interval X being considerably large compared with the pitch between the adjacent terminals. Consequently, in FIG. 10, the connectors 40 are disposed at the intervals X. When provided, this interval can compensate for pitch errors that would be caused by thermal deformation due to increased heat generated while in use and the mechanical strength of the housing.

Figure 11:
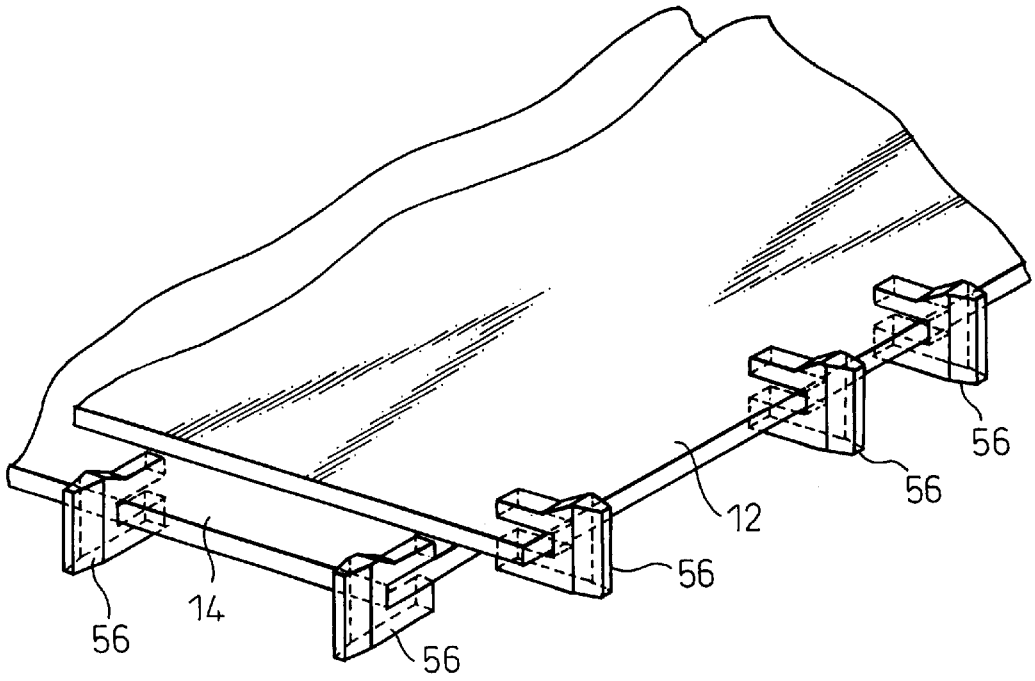
FIG. 11 is a view showing the glass substrate having spacers attached thereto.
Figure 12:
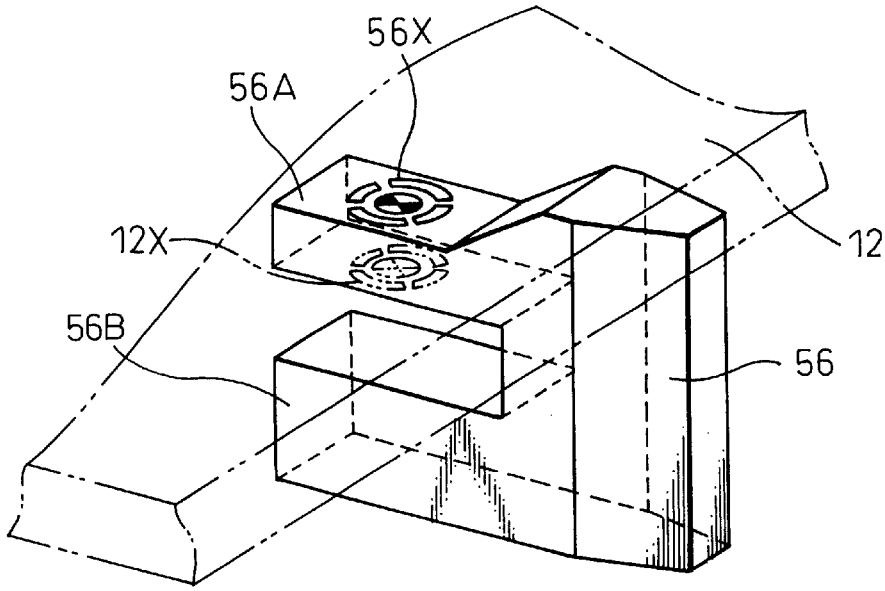
FIG. 12 is an enlarged view of the spacer of FIG. 11.

FIGS. 11 and 12 show spacers 56 which are disposed at positions corresponding to the intervals X so provided between groups of terminals. The spacers 56 are first attached to the glass substrate 12 and 14, and the connectors 40 can be attached to or detached from the glass substrates 12 and 14 using the spacers 56 as a reference (as a slide guide).

In FIG. 4, a positioning mark 12X is formed at the interval x between the groups of terminals on the glass substrate 12. The spacer 56 is made of resin and has an upper arm portion 56A and a lower arm portion 56B which are designed to hold the glass substrate 12 therebetween. The upper arm portion 56A has a positioning hole 56X corresponding to the positioning mark 12X, and in fitting the spacer 56 on the glass substrate 12, positioning of the spacer 56 is carried out by looking at the positioning mark 12X through the positioning hole 56*x*.

As shown in FIG. 10, the interval X between connectors 40 on the glass substrate 14 can be made much larger than the interval X between the connectors 40 on the glass substrate 12, since the number of address electrodes 16 is far larger than the number of sustain electrodes 18. In such a case, regarding the glass substrate 14, a pair of spacers 56 are provided at positions corresponding to opposite ends of each connector 40, and the connector 40 is inserted between the spacers so provided. Regarding the glass substrate 12, the intervals X are so tight that one spacer 56 is disposed between two adjacent connectors 40. In a case where the intervals X are even tighter, one spacer 56 is disposed every two or three connectors 40.

The first and second wedge members 52 and 54 constitute a sliding pressing mechanism, but a rotary pressing mechanism may be adopted. In addition, it is possible to arrange such that the terminals of the flexible printed circuit board 38 are fixed to the corresponding terminals of the connector 40 in advance, by soldering or any other suitable means. Additionally, something like a reinforcement plate having a certain inclination angle may be bonded to the back side of the flexible printed circuit board 38 with respect to the side having terminals, and a suitable cam such as a rotary body having an outer diameter with a outer eccentric to the center of rotation may be disposed relative to the reinforcement plate, whereby a contact pressure is generated between the terminals by virtue of a rotating motion with a part of the panel surface acting as a contact point.

Figure 13:
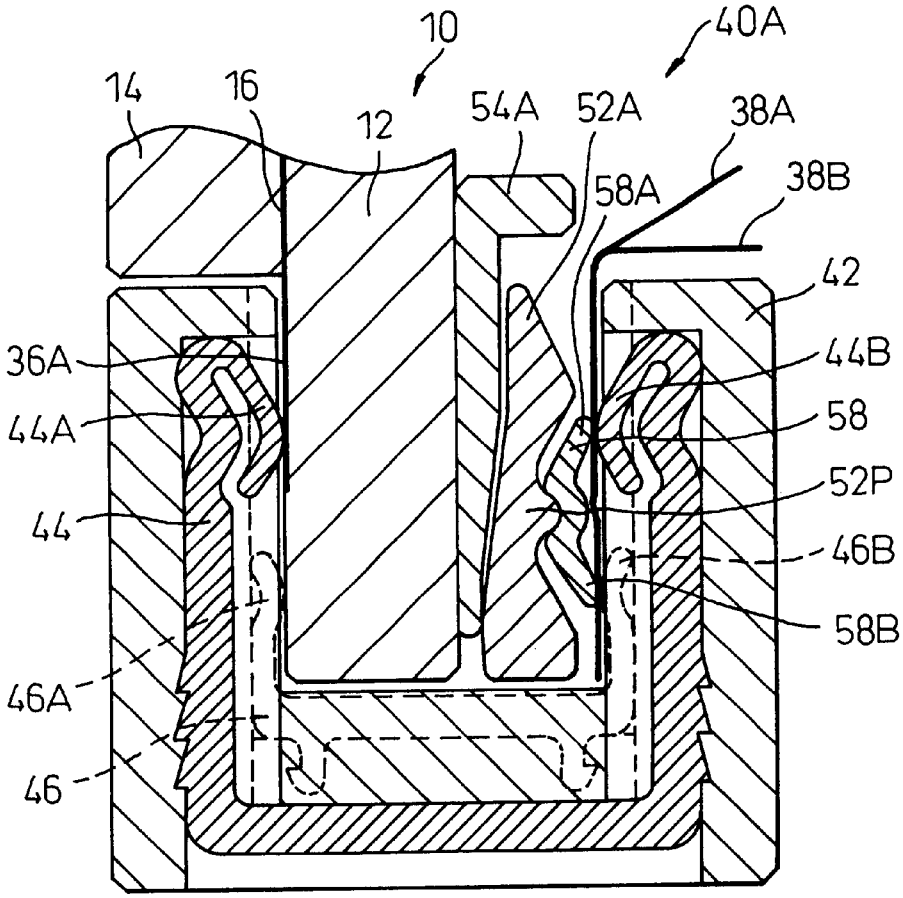
FIG. 13 is a cross-sectional view showing the connector of another embodiment.
Figure 15:
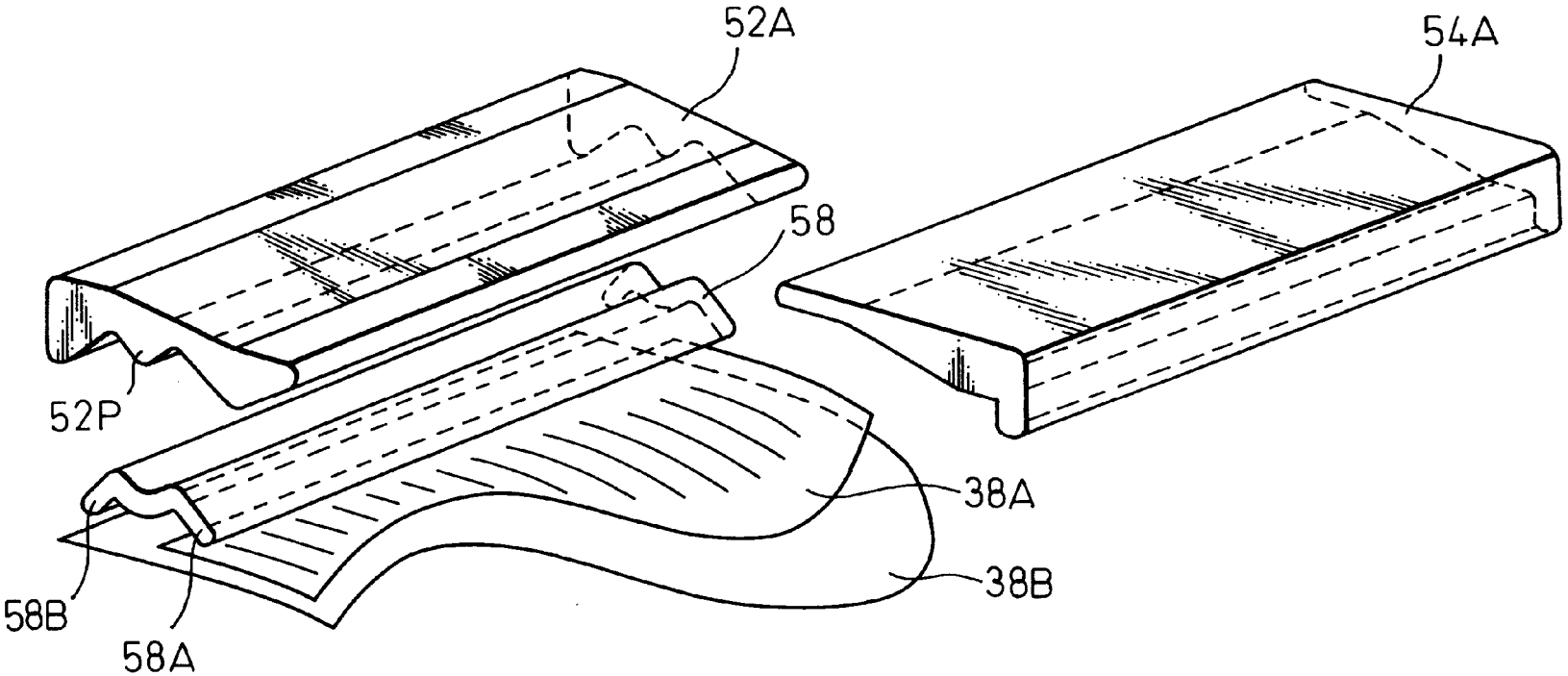
FIG. 15 is a perspective view showing first and second wedge members, the third member and flexible flat cables of FIG. 13.

FIG. 13 is a cross-sectional view showing the connector according to another embodiment of the present invention. The connector 40A shown in FIG. 13 has a housing 42 and terminals 44 and 46. The housing 42 and terminals 44 and 46 shown in FIG. 13 have the same constructions as those of the housing 42 and the terminals 44 and 46 of the connector 40 shown in FIGS. 5 to 8. First and second wedge members 52A and 54A are basically similar to those shown in FIG. 5. FIG. 15 shows the first and second wedge members 52A and 54A, a third member 58 and two flexible flat cables 38A and 38B.

In FIG. 13, the two flexible flat cables 38A and 38B are adopted, instead of the flexible printed circuit board 38. Since the flexible flat cables 38A and 38B are less expensive than the flexible printed circuit board 38, it is preferable to use them. However, as the pitch of conductors of the flexible flat cables 38A and 38B is larger than the pitch of the conductors of the flexible printed circuit board 38, they are not suitable for the plasma display device in which the electrodes 16 are disposed at the small pitch. To cope with this, the two flexible flat cables are used and disposed such that the terminals provided on one of the flexible flat cables are positioned at intermediate positions between the terminals of the other flexible flat cable, whereby the pitch of the terminals appears to be reduced by half.

Figure 14:
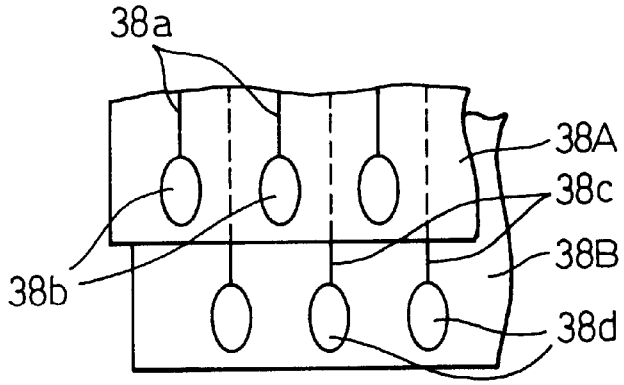
FIG. 14 is a schematic view showing two flexible flat cables of FIG. 13.

FIG. 14 is a view showing two flexible flat cables 38A and 38B shown in FIG. 13. The flexible flat cable 38A has conductors 38*a* and terminals 38*b*, and the flexible flat cable 38B has conductors 38*c* and terminals 38*d*. The flexible flat cables 38A and 38B are disposed such that the position of the conductors 38*a* and 38*c* are shifted from each other by one half of a pitch, respectively, and the terminals 38*b* and 38*d* are shifted vertically. Consequently, the arrangement of the conductors 38*a* and 38*c* and the terminals 38*b* and 38*d* becomes similar to that of the terminals 36A and 36B of the electrodes 16 shown in FIG. 4.

The first wedge member 52A is not fixed to the flexible flat cables 38A and 38B and is movably supported on the bottom of the housing 42. The first wedge member 52A has a projection 52*p*, and the third member 58 having a recessed portion adapted to be engaged with the projection 52*p* is disposed between the first wedge member 52 and the flexible flat cables 38A and 38B. The third member 58 has pressing portions 58A and 58B for pressing the upper end portions 44B, 46B of the terminals 44, 46 via the flexible flat cables 38A, 38B.

After the first wedge member 52A and the third member 58 are disposed at positions shown in the figure, the second wedge member 54A is inserted between the glass substrate 12 and the first wedge member 52A, so the first wedge member 52A and the third member 58 are pressed toward the flexible flat cables 38A and 38B, and the third member 58 presses the terminals 38*b* and 38*d* of the flexible flat cables 38A and 38B against the upper end portions 44B and 46B of the terminals 44 and 46. Since the third member 58 can rotate about the projection 52*p*, even if there exists a difference in thickness between two flexible flat cables 38A and 38B, the third member 58 can press the terminals 38*b* and 38*d* against the upper end portions 44B and 46B while absorbing the difference in thickness. Consequently, in this construction, it is ensured that electrical connections can be provided using inexpensive flexible flat cables.

Figure 16:
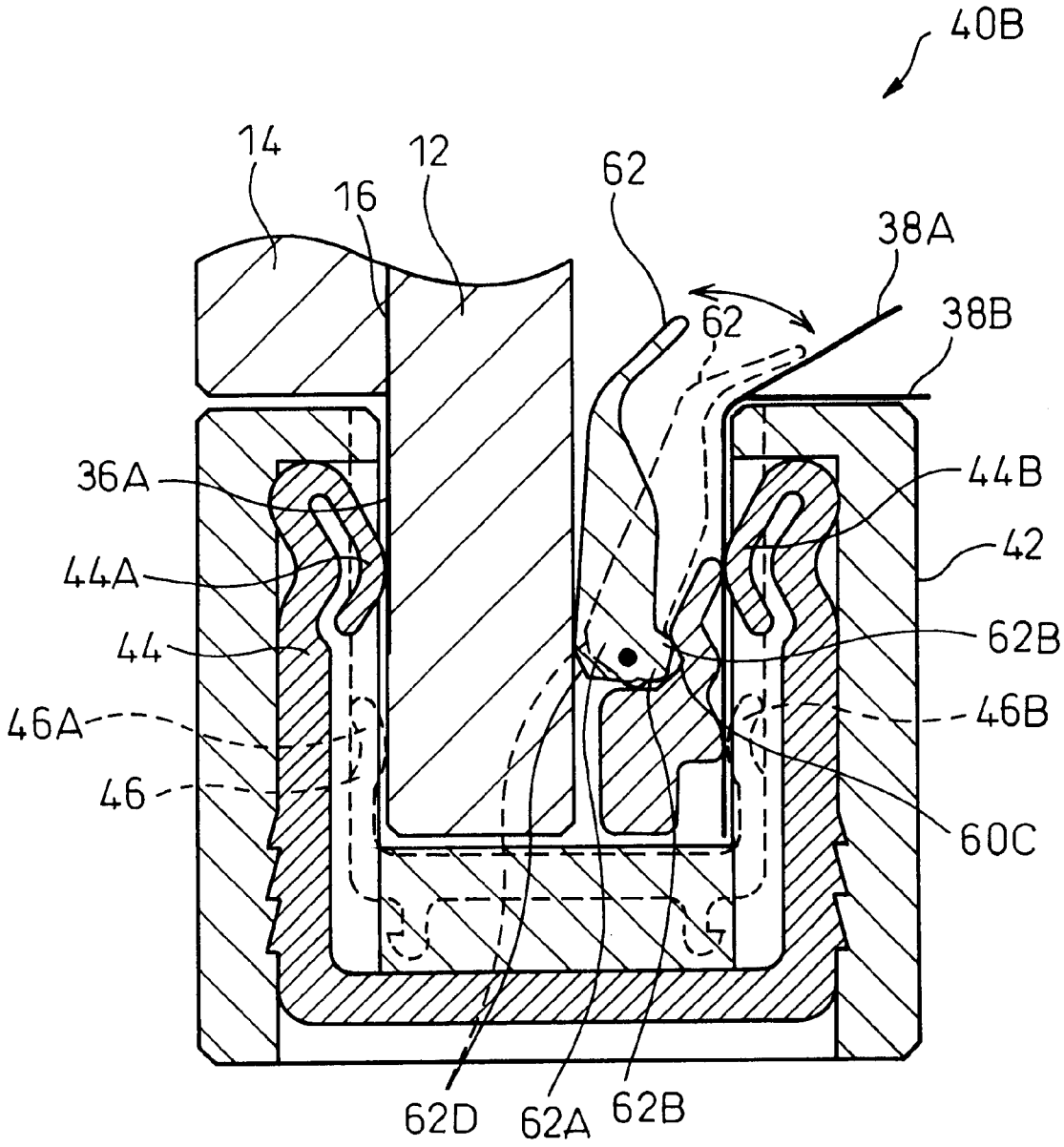
FIG. 16 is a cross-sectional view showing the connector of a further embodiment.
Figure 17:
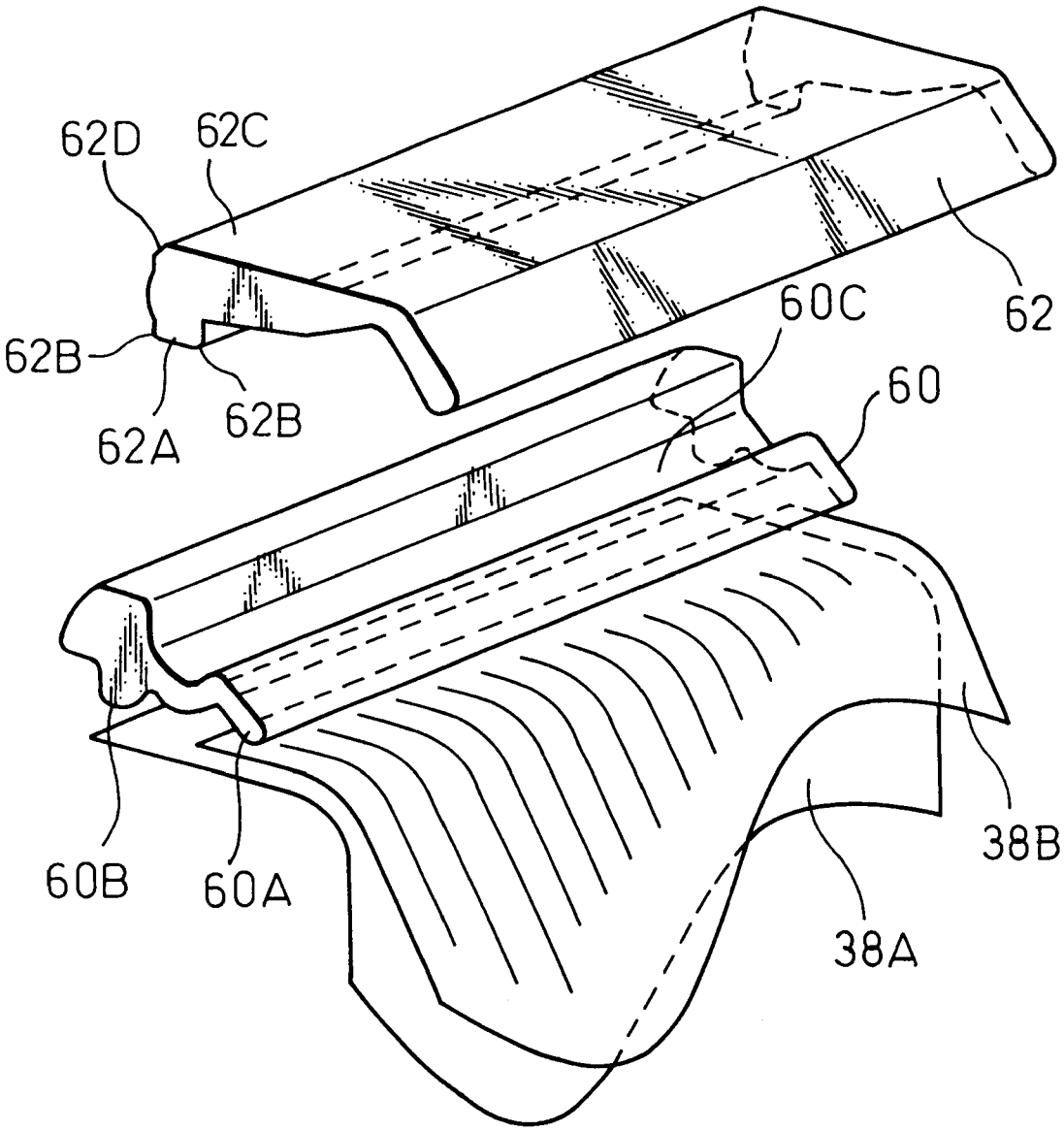
FIG. 17 is a perspective view showing the pressing member, the rotary lever and flexible flat cables of FIG. 16.

FIGS. 16 and 17 are views showing the connector 40 according to a further embodiment of the present invention. Similar to the aforesaid connectors, the connector 40B has a housing 42 and terminals 44 and 46. Furthermore, in this embodiment, two flexible flat cables 38A and 38B are adopted, and the connector 40B includes a pressing member 60 which is similar to the third member 58 of FIG. 13. The pressing member 60 has pressing portions 60A and 60B for pressing against terminals 38*a*and 38*b* (refer to FIG. 14) of two flexible flat cables 38A and 38B and a recessed portion 60C which is located on the opposite side of the pressing portions. The recessed portion 60C comprises two slopes which are disposed at predetermined angles, respectively.

The connector 40B has a rotary lever 62, instead of the sliding levers 52, 54, 52A and 54A in the previous embodiments. The rotary lever 62 has an engagement portion 62A which protrudes downwardly and has engagement portions 62B and a supporting portion 62C located on the opposite side of the engagement portion. The supporting portion 62C includes a tapered portion 62D.

In FIG. 16, the initial position of the rotary lever 62 is indicated by broken line, while the pressing position thereof is indicated by solid line. The pressing member 60 and the rotary lever 62 are inserted into the housing in a state indicated by broken line with one of the edge portions 62B being brought into engagement with the recessed portion 62C. As this occurs, the tapered portion 62D of the supporting portion 62C slides along the surface of the glass substrate 12. When the pressing member 60 and the rotary lever 62 are inserted into a predetermined position, the rotary lever 62 is rotated from a position indicated by broken line to a position indicated by solid line. Then, the engagement portion 62 rotates relative to the recessed portion 60C, the edge portion 62B of the engagement portion 62A is disengaged from the recessed portion 60C, and the two edge portions 62B are positioned on the slope of the tapered portion 62D, whereby a projecting portion formed by an end of the tapered portion 62D of the supporting portion 62C of the rotary lever 62 comes into contact with the surface of the glass substrate 12. Due to this, the pressing member 60 is pressed toward the flexible flat cables 38A and 38B by the rotary lever 62. Thus, the rotary lever 62 functions as the aforesaid cam of the rotary pressing mechanism. Note that a flexible printed circuit board or flat cables may be used instead of the flexible flat cables.

As explained in detail, according to the present invention, a plasma display device can be provided in which the flexible member is detachably attached to the substrate by means of the connectors.

What is claimed is:

1. A plasma display device comprising:

a pair of substrates, each substrate having a plurality of electrodes and a plurality of electrode terminals at ends of respective said electrodes;

a driving circuit supplying a driving voltage to said electrodes on one of said substrates;

a flexible connecting member comprising plural conductors extending from said driving circuit; and a connector, detachably attached to said one substrate, having a housing and a plurality of connector terminals disposed in said housing, each connector terminal having a first portion contacting a corresponding electrode terminal and a second portion contacting a corresponding conductor of said flexible connecting member.

2. A plasma display device according to claim 1, wherein said housing and said connector terminals are formed in a U-shaped cross-sectional shape so that said connectors can be detachably attached to said substrate.

3. A plasma display device according to claim 2, further comprising a pressing mechanism fixedly holding said connector to said substrate.

4. A plasma display device according to claim 1, wherein said flexible connecting member comprises one of a flexible printed circuit board, a flat cable and a flexible flat cable.

5. A plasma display device according to claim 2, wherein said electrode terminals include a plurality of groups of electrode terminals which are disposed at respective, different distances from a corresponding edge of said substrate, and said connector terminals include a plurality of different kinds of connector terminals corresponding to said plurality of groups of electrode terminals.

6. A plasma display device according to claim 5, wherein said housing of the connector has grooves and the connector terminals comprise elastically deformable metallic materials which are inserted in the grooves.

7. A plasma display device according to claim 6, wherein connector terminals of a first kind are inserted into associated grooves from one side, and connector terminals of a second kind are inserted into the associated grooves from a second, opposite side.

8. A plasma display device according to claim 7, wherein said first kind of connector terminals contact corresponding said electrode terminals which are located at a first distance from the corresponding edge of the substrate, and said second kind of connector terminals contact the electrode terminals which are located at a second distance from the corresponding edge of the substrate.

9. A plasma display device according to claim 3, wherein said pressing mechanism for fixedly holding the connector to the substrate comprises at least one of a sliding pressing mechanism and a rotary pressing mechanism.

10. A plasma display device according to claim 3, wherein said pressing mechanism for fixedly holding the connector to the substrate includes a pressing member disposed between the substrate and the connector terminals, and an operating member for pressing the pressing member toward the end of the connector.

11. A plasma display device according to claim 10, wherein said flexible connecting member is fixed to the pressing member.

12. A plasma display device according to claim 10, wherein said flexible connecting member comprises at least two flexible circuit members, and the pressing member commonly contacts two flexible circuit members.

13. A plasma display device according to claim 1, wherein said electrode terminals comprise a plurality of groups of electrode terminals disposed with an interval between each two adjacent groups of electrode terminals, and an individual, respective said connector is disposed relative to each group of electrode terminals, and a spacer is disposed in the interval.

14. A connector detachably attachable to a substrate at an edge thereof with electrodes supported on the substrate having electrode terminals at respective ends thereof disposed adjacent the edge of the substrate, the connector comprising:

a housing having a plurality of connector terminals disposed in said housing, each connector terminal having a first portion connectable to a corresponding electrode terminal and a second portion; and a flexible connecting member comprising plural conductors connectable at respective first ends thereof to corresponding second portions of said connector terminals and connectable at respective second ends thereof to associated circuits displaced from the substrate.

15. A connector according to claim 14, wherein said housing and said connector terminals are U-shaped in cross-section, affording detachable attachment thereof to said substrate.

16. A connector according to claim 15, further comprising a pressing mechanism fixedly holding said connector to said substrate.

17. A connector according to claim 14, wherein said flexible connecting member comprises one of a flexible printed circuit board, a flat cable and a flexible flat cable.

18. A connector according to claim 15, wherein said electrode terminals include a plurality of groups of electrode terminals which are disposed at respective, different distances from a corresponding edge of said substrate, and said connector terminals include a plurality of different kinds of connector terminals corresponding to said plurality of groups of electrode terminals.

19. A connector according to claim 18, wherein said housing of the connector has grooves and the connector terminals comprise elastically deformable metallic materials which are inserted in the grooves.

20. A connector according to claim 19, wherein connector terminals of a first kind are inserted into associated grooves from one side, and connector terminals of a second kind are inserted into the associated grooves from a second, opposite side.

21. A connector according to claim 20, wherein said first kind of connector terminals contact corresponding said electrode terminals which are located at a first distance from the corresponding edge of the substrate, and said second kind of connector terminals contact the electrode terminals which are located at second distance from the corresponding edge of the substrate.

22. A connector according to claim 16, wherein said pressing mechanism for fixedly holding the connector to the substrate comprises at least one of a sliding pressing mechanism and a rotary pressing mechanism.

23. A connector according to claim 16, wherein said pressing mechanism for fixedly holding the connector to the substrate includes a pressing member disposed between the substrate and the connector terminals, and an operating member for pressing the pressing member toward the end of the connector.

24. A connector according to claim 23, wherein said flexible connecting member is fixed to the pressing member.

25. A connector according to claim 23, wherein said flexible connecting member comprises at least two flexible circuit members, and the pressing member commonly contacts two flexible circuit members.

26. A connector according to claim 14, wherein said electrode terminals comprise a plurality of groups of electrode terminals disposed with an interval between each two adjacent groups of electrode terminals, and an individual, respective said connector is disposed relative to each group of electrode terminals, and a spacer is disposed in the interval.

* * * * *

UNITED STATES PATENT AND TRADEMARK OFFICE

CERTIFICATE OF CORRECTION

PATENT NO. : 6,636,000 B2
DATED : October 21, 2003
INVENTOR(S) : Fumitaka Asami et al.

It is certified that error appears in the above-identified patent and that said Letters Patent is hereby corrected as shown below:

Title page,
Item [56], References Cited, FOREIGN PATENT DOCUMENTS, change "11-627458" to -- 11-327458 --; and change "11-627503" to -- 11-327503 --.

Signed and Sealed this

Thirtieth Day of December, 2003

JAMES E. ROGAN
*Director of the United States Patent and Trademark Office*